US011394153B2

(12) United States Patent
Chen et al.

(10) Patent No.: US 11,394,153 B2
(45) Date of Patent: Jul. 19, 2022

(54) CONNECTOR AND TERMINAL

(71) Applicant: Molex, LLC, Lisle, IL (US)

(72) Inventors: Zhi-Dong Chen, Shanghai (CN); Hao Yin, Shanghai (CN)

(73) Assignee: Molex, LLC, Lisle, IL (US)

( * ) Notice: Subject to any disclaimer, the term of this patent is extended or adjusted under 35 U.S.C. 154(b) by 71 days.

(21) Appl. No.: 16/941,543

(22) Filed: Jul. 29, 2020

(65) Prior Publication Data

US 2021/0044055 A1 Feb. 11, 2021

(30) Foreign Application Priority Data

Aug. 8, 2019 (CN) ..... 201910730463.6

(51) Int. Cl.
*H01R 13/53* (2006.01)
*H01R 13/422* (2006.01)
*H01R 13/11* (2006.01)

(52) U.S. Cl.
CPC ..... *H01R 13/53* (2013.01); *H01R 13/114* (2013.01); *H01R 13/4223* (2013.01)

(58) Field of Classification Search
CPC .. H01R 13/114; H01R 13/53; H01R 13/4223; H01R 13/5202; H01R 13/627;
(Continued)

(56) References Cited

U.S. PATENT DOCUMENTS 4,734,064 A * 3/1988 Knapp ..... H01R 43/16 439/852
4,900,271 A * 2/1990 Colleran ..... H01R 13/113 439/275
(Continued)

FOREIGN PATENT DOCUMENTS

CA 1124809 A 6/1982
CN 103155295 A 6/2013
(Continued)

OTHER PUBLICATIONS

Office Action received for CN Application No. 201910730463.6, dated Sep. 15, 2021, 14 Pages (07 Pages of English Translation and 07 Pages of Official notification).

*Primary Examiner* — Marcus E Harcum

(57) ABSTRACT

The present disclosure provides a connector and a terminal. The connector includes a terminal. The terminal includes an insert portion. The insert portion includes a front frame portion, a rear frame portion, a top plate portion, an arc discharge contact member and a primary contact member. The arc discharge contact member includes a bottom plate portion and a top elastic arm. The bottom plate portion connects the front frame portion and the rear frame portion and is spaced apart from the top plate portion in an up-down direction. The top elastic arm extends from the rear frame portion to the front frame portion and is positioned below the top plate portion. The arc discharge contact member is positioned in front of the primary contact member. The primary contact member includes a first elastic arm and a second elastic arm. The first elastic arm extends from the rear frame portion to the front frame portion and is adjacent between the bottom plate portion and the top elastic arm. The second elastic arm extends from the rear frame portion to the front frame portion, is adjacent between the top plate portion and the bottom plate portion, and spaced apart from the first elastic arm in a left-right direction.

20 Claims, 12 Drawing Sheets

(58) Field of Classification Search
CPC ..... H01R 13/113; H01R 13/17; H01R 13/18; H01R 43/16; H01R 2201/26; H01R 4/185
USPC ..... 439/852, 851, 856, 752, 752.5, 845
See application file for complete search history.

(56) References Cited

U.S. PATENT DOCUMENTS 5,281,168 A * 1/1994 Krehbiel ..... H01R 13/4362 439/595
5,286,221 A * 2/1994 Fencl ..... H01R 13/7195 439/607.53
5,437,566 A * 8/1995 Zinn ..... H01R 13/113 439/839
5,468,163 A * 11/1995 Egenolf ..... H01R 13/7032 439/839
5,533,914 A * 7/1996 Sawada ..... H01R 13/187 439/843
5,607,328 A * 3/1997 Joly ..... H01R 13/11 439/851
5,667,413 A * 9/1997 Trafton ..... H01R 13/187 439/271
5,755,599 A * 5/1998 Hotea ..... H01R 13/18 439/745
5,921,822 A * 7/1999 Kennedy ..... H01R 13/187 439/851
5,951,336 A * 9/1999 Seko ..... H01R 13/432 439/745
5,951,338 A * 9/1999 Seko ..... H01R 13/18 439/843
5,975,964 A * 11/1999 Seko ..... H01R 13/18 439/857
6,386,928 B2 * 5/2002 Kitamura ..... H01R 13/113 439/852
6,394,858 B1 * 5/2002 Geltsch ..... H01R 13/114 439/852
6,439,935 B2 * 8/2002 Saka ..... H01R 13/113 439/842
6,475,040 B1 * 11/2002 Myer ..... H01R 13/11 439/374
6,478,635 B2 * 11/2002 Charles ..... H01R 4/185 439/851
6,672,910 B2 * 1/2004 Hotea ..... H01R 13/4223 439/843
6,790,101 B1 * 9/2004 Data ..... H01R 13/04 439/181
6,872,103 B1 * 3/2005 Flieger ..... H01R 13/18 439/839
6,905,376 B2 * 6/2005 Chen ..... H01R 13/04 439/595
6,908,348 B2 6/2005 Zhao et al.
6,918,798 B2 * 7/2005 Patel ..... H01R 13/114 439/851
6,945,830 B2 * 9/2005 Copper ..... H01R 13/057 439/748
7,014,515 B2 * 3/2006 Lutsch ..... H01R 13/113 439/843
7,252,559 B1 8/2007 Morello et al.
7,300,319 B2 * 11/2007 Lutsch ..... H01R 4/185 439/845
7,419,410 B2 * 9/2008 Myer ..... H01R 13/113 439/852
7,419,411 B2 * 9/2008 Kaneko ..... H01R 13/113 439/851
7,458,863 B2 * 12/2008 Shimizu ..... H01R 43/16 439/842
7,503,813 B1 * 3/2009 Osterhart ..... H01R 13/113 439/852
7,530,859 B2 * 5/2009 Moll ..... H01R 4/185 439/852
7,976,351 B2 * 7/2011 Boemmel ..... H01R 13/432 439/748
7,988,505 B2 * 8/2011 Hotea ..... H01R 13/187 439/852
8,858,274 B2 * 10/2014 Jakoplic ..... H01R 13/11 439/877
9,011,186 B2 * 4/2015 Wirth ..... H01R 13/112 439/852
9,118,131 B2 * 8/2015 Jakoplic ..... H01R 13/113
9,160,082 B2 * 10/2015 Heringhaus ..... H01R 13/193
9,318,838 B2 * 4/2016 Karadimas ..... H01R 13/53
9,666,957 B2 * 5/2017 Endo ..... H01R 4/48
10,297,940 B2 * 5/2019 Tanikawa ..... H01R 13/4223
10,862,226 B2 * 12/2020 Mochizuki ..... H01R 4/4818
11,152,730 B2 * 10/2021 Nishii ..... H01R 4/185
2002/0076999 A1 * 6/2002 Chen ..... H01R 13/187 439/851
2004/0127107 A1 * 7/2004 Lischeck ..... H01R 13/18 439/851
2005/0014422 A1 * 1/2005 Patel ..... H01R 13/114 439/851
2005/0118891 A1 * 6/2005 Chen ..... H01R 13/187 439/851
2005/0176298 A1 * 8/2005 Flowers ..... H01R 13/4365 439/595
2006/0035538 A1 * 2/2006 Suemitsu ..... H01R 13/187 439/852
2006/0040533 A1 * 2/2006 Koshy ..... H01R 13/62977 439/157
2006/0292937 A1 * 12/2006 Morello ..... H01R 13/113 439/856
2008/0070452 A1 * 3/2008 Komiyama ..... H01R 13/113 439/852
2009/0075530 A1 * 3/2009 Schneider ..... H01R 4/185 439/834
2010/0173539 A1 * 7/2010 Furutani ..... H01R 4/185 439/852
2012/0142233 A1 * 6/2012 Blasko ..... H01R 13/113 439/852
2013/0273790 A1 * 10/2013 Jakoplic ..... H01R 13/17 439/891
2014/0302702 A1 * 10/2014 Germ ..... H01R 13/639 439/370
2015/0118902 A1 * 4/2015 Data ..... H01R 13/6315 439/587
2015/0155670 A1 * 6/2015 Gardner ..... H01R 13/5208 439/587
2016/0028169 A1 * 1/2016 Glick ..... H01R 13/18 439/816
2016/0072203 A1 * 3/2016 Ii ..... H01R 13/113 439/816
2016/0322728 A1 * 11/2016 Endo ..... H01R 13/187
2016/0344115 A1 * 11/2016 Miyakawa ..... H01R 13/52
2017/0040728 A1 * 2/2017 Saito ..... H01R 13/11
2017/0047677 A1 * 2/2017 Bhagyanathan Sathianathan ..... H01R 13/18
2018/0076577 A1 * 3/2018 Ishida ..... H01R 13/506
2018/0183165 A1 * 6/2018 Balser ..... H01R 13/434

FOREIGN PATENT DOCUMENTS

CN 103378442 A 10/2013
CN 103748745 A 4/2014
CN 104488140 B 3/2017
JP 2003086278 A * 3/2003 ..... H01R 13/7137
JP 3684319 B2 8/2005
TW D194913 S 12/2018
TW 201916503 A 4/2019
WO WO-2016048271 A * 3/2016 ..... H01R 13/113

* cited by examiner

1

21

21

21

21

CONNECTOR AND TERMINAL

RELATED APPLICATIONS

This application claims priority to Chinese Application No. 201910730463.6 filed on Aug. 8, 2019, which is incorporated herein by reference in its entirety.

TECHNICAL FIELD

The present disclosure relates to a connector and a terminal, particularly relates to a power connector and a terminal thereof.

BACKGROUND

Chinese Patent application No. CN201180049216.1 discloses a female-type metal terminal fitting. The female-type metal terminal fitting includes a case portion, a lance engagement portion, a spring support plate portion, a terminal biasing plate spring and a wire connection portion.

The case portion is a portion into which a male-type metal terminal fitting is inserted, and the case portion is formed in an angular case shape which includes a bottom plate portion, two side wall portions raised up from two side edges of the bottom plate portion and a top plate portion connecting upper ends of two side wall portions.

A contact portion for contacting a male-type metal terminal is formed at the bottom plate portion so as to protrude from the bottom plate portion. The lance engagement portion has a curved portion which is convex to the upper side at a portion where a lance in a connector housing is engaged so that the stiffness thereof is enhanced. The spring support plate portion is arranged so as to be laminated on an inner surface of an upper plate portion.

The terminal bias plate spring is formed so as to extend from the spring support plate portion to a front end side of the bottom plate portion. A front end of the terminal bias plate spring is arranged at a position opposite to the contact portion of the bottom plate portion and makes the male-type metal terminal fitting closely contact the contact portion. The wire connecting portion includes a sheath fixing piece which clamps a sheath portion of a sheathed wire and a wire pressing piece which clamps a conductive portion of the sheath wire.

However, the female-type metal terminal fitting does not have an arc discharge contact point and a stable front frame latching structure. In this way, when the female-type metal terminal fitting and the male-type metal terminal fitting are hot plugged, an electric spark will be generated on the primary contact point of the female-type metal terminal fitting. In addition, when the male-type metal terminal fitting is obliquely inserted into the female-type metal terminal fitting, the female-type metal terminal fitting is easily deformed.

The description of the above "background" only provides a background, and it is not admitted that the description of the above "background" discloses the protection scope of the present disclosure, and the description of the above "background" does not constitute the background of the present disclosure, and any description of the above "background" should not be considered as any part of the present disclosure.

SUMMARY

An embodiment of the present disclosure provides a connector. The connector comprises an insulating housing and a terminal. The insulating housing defines a terminal receiving groove therein, and the insulating housing comprises a stop wall. The terminal is positioned in the terminal receiving groove of the insulating housing, and the terminal comprises an insert portion, a wiring portion and a connecting portion. The insert portion defines an insert space therein, and the insert portion comprises a front frame portion, a rear frame portion, a top plate portion, an arc discharge contact member and a primary contact member. The rear frame portion is spaced apart from the front frame portion in a front-rear direction. The top plate portion connects the front frame portion and the rear frame portion. The arc discharge contact member comprises a bottom plate portion and a top elastic arm. The bottom plate portion connects the front frame portion and the rear frame portion and is spaced apart from the top plate portion in an up-down direction. The top elastic arm extends from the rear frame portion to the front frame portion and is positioned below the top plate portion. The arc discharge contact member is positioned in front of the primary contact member. The primary contact member comprises a first elastic arm and a second elastic arm. The first elastic arm extends from the rear frame portion to the front frame portion and is adjacent between the bottom plate portion and the top elastic arm. The second elastic arm extends from the rear frame portion to the front frame portion, is adjacent between the top plate portion and the bottom plate portion, and is spaced apart from the first elastic arm in a left-right direction. The connecting portion connects the insert portion and the wiring portion. The connecting portion comprises a stopping portion which is configured to abut against the stop wall of the insulating housing.

In some embodiments, the bottom plate portion comprises a bottom plate contact portion. The top elastic arm comprises a top contact portion which faces the bottom plate contact portion and is positioned in the insert space. The first elastic arm comprises a first contact portion which is positioned in the insert space. The second elastic arm comprises a second contact portion which faces the first contact portion and is positioned in the insert space, wherein the top contact portion and the bottom plate contact portion are positioned in front of the first contact portion and the second contact portion.

In some embodiments, the front frame portion and the rear frame portion each comprise a first end portion and a second end portion which are opposite to each other, the first end portion is connected with the top plate portion, the second end portion is a free end, and the top plate portion is positioned above the front frame portion and the rear frame portion.

In some embodiments, the front frame portion comprises a first end portion and a second end portion which are opposite to each other, the first end portion is connected with the top plate portion, the first end portion comprises a catch hole, and the second end portion comprises a protrusion which is configured to insert into the catch hole.

In some embodiments, the rear frame portion comprises a rear frame bottom portion, and wherein the connecting portion further comprises a connecting bottom portion which is lower than the rear frame bottom portion, and a step portion which connects the connecting bottom portion and the rear frame bottom portion.

In some embodiments, there is a gap between the bottom plate portion of the terminal and an inner wall of the insulating housing in the up-down direction.

In some embodiments, the bottom plate contact portion is formed by bulging the bottom plate portion toward the insert space.

In some embodiments, an edge bulging portion bulges upwardly from a rear edge of the top plate portion, and the insulating housing further comprises a locking shoulder which latches with the edge bulging portion and has elasticity.

In some embodiments, the bottom plate contact portion, the top contact portion, the first contact portion and the second contact portion are respectively provided at a down side, an up side, a left side and a right side of the insert space.

In some embodiments, the top contact portion, the first contact portion and the second contact portion are respectively positioned in a tip of the top elastic arm, a tip of the first elastic arm and a tip of the second elastic arm.

In some embodiments, the top contact portion, the first contact portion and the second contact portion each are an elliptical surface.

In some embodiments, the connector is a vehicle connector.

Another embodiment of the present disclosure provides a terminal. The terminal comprises an insert portion, a wiring portion and a connecting portion. The insert portion defines an insert space therein, and the insert portion comprises a front frame portion, a rear frame portion, a top plate portion, an arc discharge contact member and a primary contact member. The rear frame portion is spaced apart from the front frame portion in a front-rear direction. The top plate portion connects the front frame portion and the rear frame portion. The arc discharge contact member comprises a bottom plate portion and a top elastic arm. The bottom plate portion connects the front frame portion and the rear frame portion and is spaced apart from the top plate portion in an up-down direction. The top elastic arm extends from the rear frame portion to the front frame portion and is positioned below the top plate portion. The arc discharge contact member is positioned in front of the primary contact member. The primary contact member comprises a first elastic arm and a second elastic arm. The first elastic arm extends from the rear frame portion to the front frame portion and is adjacent between the bottom plate portion and the top elastic arm. The second elastic arm extends from the rear frame portion to the front frame portion, is adjacent between the top plate portion and the bottom plate portion and is spaced apart from the first elastic arm in a left-right direction. The connecting portion connects the insert portion and the wiring portion. The connecting portion comprises a stopping portion which is configured to abut against the stop wall of the insulating housing.

In some embodiments, the bottom plate portion comprises a bottom plate contact portion. The top elastic arm comprises a top contact portion which faces the bottom plate contact portion and is positioned in the insert space. The first elastic arm comprises a first contact portion which is positioned in the insert space. The second elastic arm comprises a second contact portion which faces the first contact portion and is positioned in the insert space, wherein the top contact portion and the bottom plate contact portion are positioned in front of the first contact portion and the second contact portion.

In some embodiments, the front frame portion and the rear frame portion each comprise a first end portion and a second end portion which are opposite to each other, the first end portion is connected with the top plate portion, the second end portion is a free end, and the top plate portion is positioned above the front frame portion and the rear frame portion.

In some embodiments, the front frame portion comprises a first end portion and a second end portion which are opposite to each other, the first end portion is connected with the top plate portion, and the first end portion comprises a catch hole, the second end portion comprises a protrusion which is configured to insert into the catch hole.

In some embodiments, the rear frame portion comprises a rear frame bottom portion, and wherein the connecting portion further comprises a connecting bottom portion which is lower than the rear frame bottom portion and a step portion which connects the connecting bottom portion and the rear frame bottom portion.

In some embodiments, the bottom plate contact portion is formed by bulging the bottom plate portion toward the insert space.

In some embodiments, an edge bulging portion bulges upwardly from a rear edge of the top plate portion.

In some embodiments, the bottom plate contact portion, the top contact portion, the first contact portion and the second contact portion are respectively provided at a down side, an up side, a left side and a right side of the insert space.

In some embodiments, the top contact portion, the first contact portion and the second contact portion are respectively positioned in a tip of the top elastic arm, a tip of the first elastic arm and a tip of the second elastic arm.

In some embodiments, the top contact portion, the first contact portion and the second contact portion each are an elliptical surface.

In the present disclosure, because of the arrangement of the protrusion and the catch hole of the front frame portion of the terminal, the front frame portion of the terminal is relatively difficult to deform, thereby avoiding the terminal being damaged by the male terminal when the male terminal is obliquely inserted into the terminal.

In addition, the terminal comprises four contact points, in which the first contact portion in the left and the second contact portion in the right are the primary contact points, and the top contact portion in the up and the bottom plate contact portion in the down are secondary contact points. When the male terminal is inserted under electric hot plug, the top contact portion in the up and the bottom plate contact portion in the down contact the male terminal earlier than the first contact portion in the left and the second contact portion in the right. In this way, the electric spark generated by the insertion will be only remained on the top contact portion in the up and the bottom plate contact portion in the down, the first contact portion in the left and the second contact portion the right will not be affected. Therefore, the terminal has a function of hot plug.

Furthermore, three of the four contact points are respectively positioned in the tip of the top elastic arm, the tip of the first elastic arm and the tip of the second elastic arm. Because the top elastic arm, the first elastic arm and the second elastic arm are cantilever structures, the top elastic arm, the first elastic arm and the second elastic arm have good flexibility, the top elastic arm, the first elastic arm and the second elastic arm are more resistant to fretting corrosion with respect to the terminal contact surfaces thereof.

The technical features and advantages of the present disclosure have been generalized quite broadly above, so that the detailed description of the present application below can be better understood. Other technical features and advantages constituting the protection scope of the claims of the present disclosure will be described below. Those skilled persons in the art should understand that the concepts and specific embodiments disclosed below can be easily utilized to modify or design other structures or manufacturing methods to achieve the same purpose as the present disclosure. Those skilled persons in the art should also understand that such equivalent construction cannot depart from the spirit and scope defined by the appended claims of the present disclosure.

BRIEF DESCRIPTION OF THE DRAWINGS

The disclosed contents of the present disclosure can be more fully understood in conjunction with the detailed description and claims referring to the drawings, and the same reference numeral indicates the same element in the drawings.

DETAILED DESCRIPTION OF THE PREFERRED EMBODIMENTS

Figure 1:
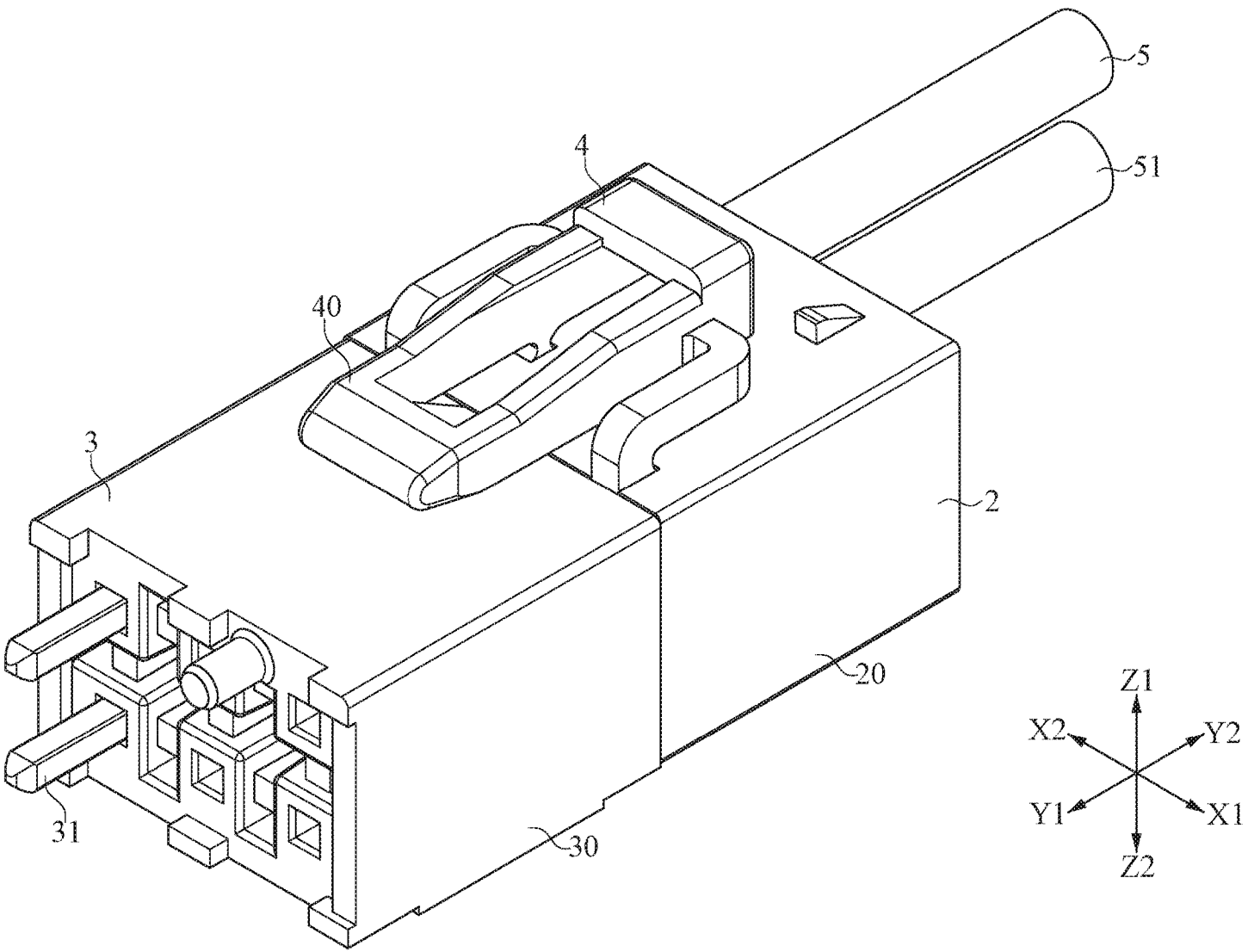
FIG. 1 is an assembled schematic perspective view of a power connector.

The embodiments or examples of the disclosed contents illustrated in the drawings are described in specific languages. It should be understood that it is not intended to limit the scope of the present disclosure. Any change or modification of the embodiments and any further application of the principles described in the present disclosure can occur normally for those skilled persons in the art. Reference numerals may be repeated in each embodiment, but even if they have the same reference numerals, the features in an embodiment are not necessarily used in another embodiment.

The following detailed description describes various exemplary embodiments and it is not intended to limit the present disclosure to the explicitly disclosed combinations. Therefore, unless otherwise stated, the features disclosed herein may be combined together to form multiple additional combinations not shown for the sake of conciseness.

A female terminal of the present disclosure helps to control discharge arc that occurs between the female terminal and a male terminal mated with the female terminal when a power connector is hot plugged. Some embodiments permit the female terminal to include one or more sacrificial electrical contacts, and these sacrificial electrical contacts are configured to engage with the mating male terminal so as to release any arc before the mating male terminal engages with a primary contact member of the female terminal. Therefore, the female terminal of the present disclosure has a protection (function) of the arc discharge against the primary contact member of the female terminal.

Figure 2:
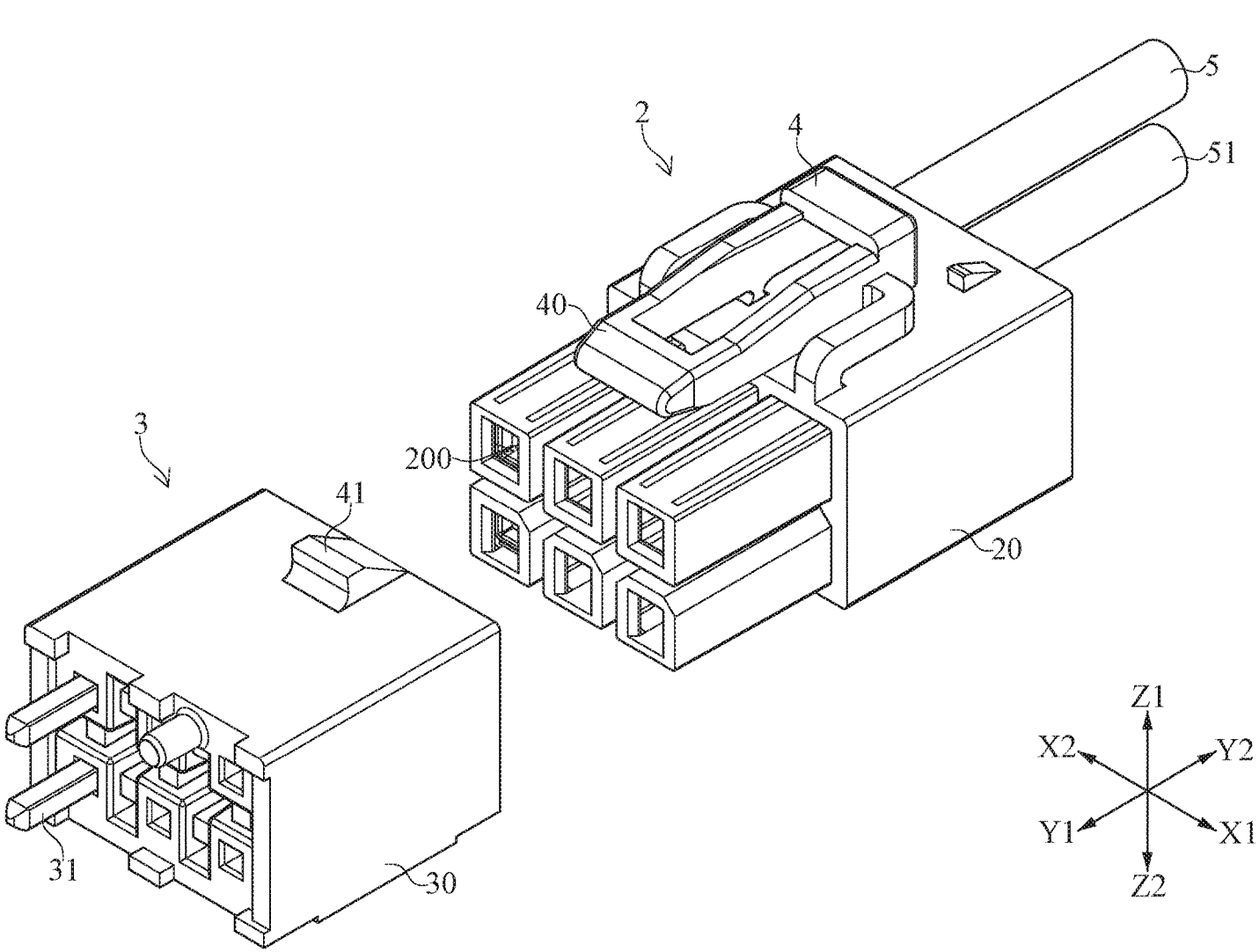
FIG. 2 is an exploded schematic perspective view of the power connector with respect to FIG. 1.
Figure 3:
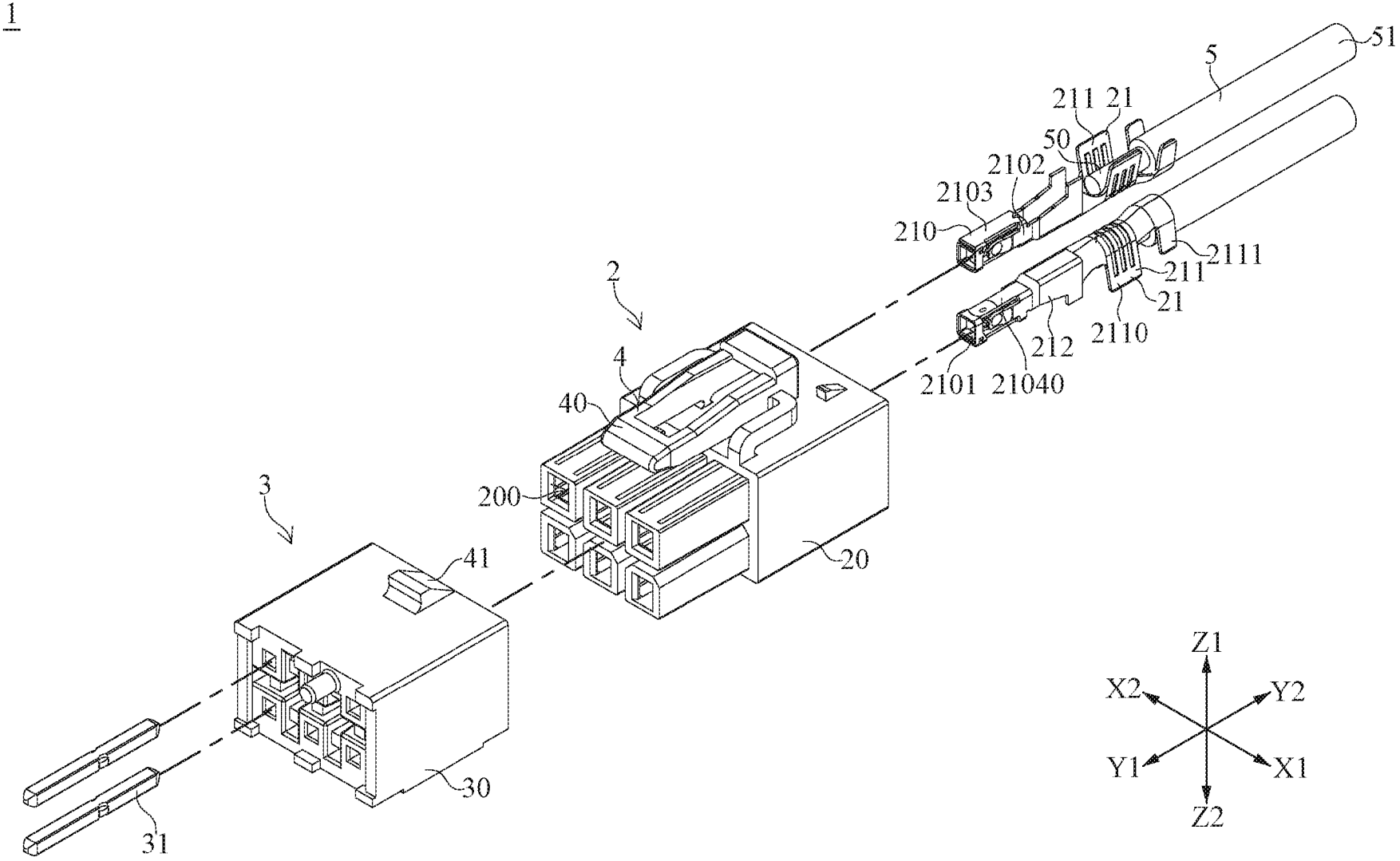
FIG. 3 is an exploded schematic perspective view of a plug connector and a receptacle connector of FIG. 2.

FIG. 1 is an assembly schematic perspective view of a power connector 1. FIG. 2 is an exploded schematic perspective view of the power connector 1 with respect to FIG. 1. FIG. 3 is an exploded schematic perspective view of a plug connector 2 and a receptacle connector 3 of FIG. 2. Referring to FIG. 1 to FIG. 3, the power connector 1 includes a plug connector 2 connecting a plurality of wire 5, a receptacle connector 3 mating with the plug connector 2 in a front-rear direction Y1-Y2 and a locking structure 4 holding the plug connector 2 and receptacle connector 3 together. Only two wires 5 are illustrated as an example in the embodiment. In the present disclosure, the plug connector 2 may also be referred to as a connector 2.

The plug connector 2 includes an insulating housing 20 and a plurality of female terminals 21 positioned in the insulating housing 20. Only two female terminals 21 are illustrated as an example in the embodiment. In the present disclosure, the female terminal 21 may also be referred to as a terminal 21. Specifically, the insulating housing 20 defines a plurality of terminal receiving grooves 200 extending in the front-rear direction Y1-Y2 therein. Each female terminal 21 is positioned in the corresponding terminal receiving groove 200. In some embodiments, each female terminal 21 is formed by stamping a metalplate.

The receptacle connector 3 includes an insulating housing 30 and a plurality of male terminals 31 positioned in the insulating housing 30. Only two male terminals 31 are illustrated as an example in the embodiment. The locking structure 4 includes an elastic latching portion 40 and a locking portion 41. In the embodiment, the elastic latching portion 40 is provided on the insulating housing 20 of the plug connector 2, and the locking portion 41 is provided on the insulating housing 30 of the receptacle connector 3. However, the locking structure 4 of the present disclosure is not limited thereto. Any structure that can hold the plug connector 2 and the receptacle connector 3 together is a potential implementing manner.

Figure 4:
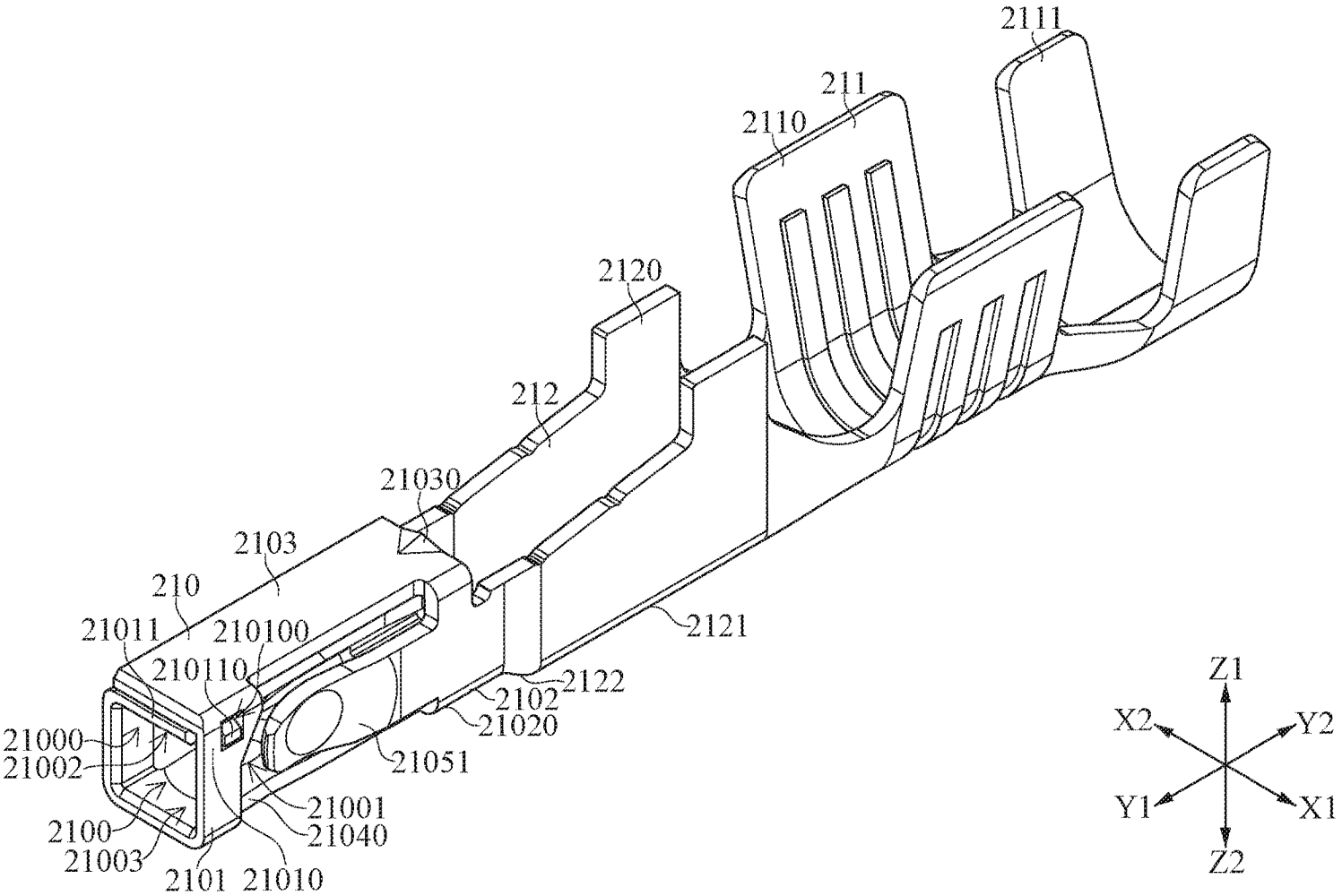
FIG. 4 is a schematic perspective view of a female terminal of the plug connector of FIG. 3.
Figure 5:
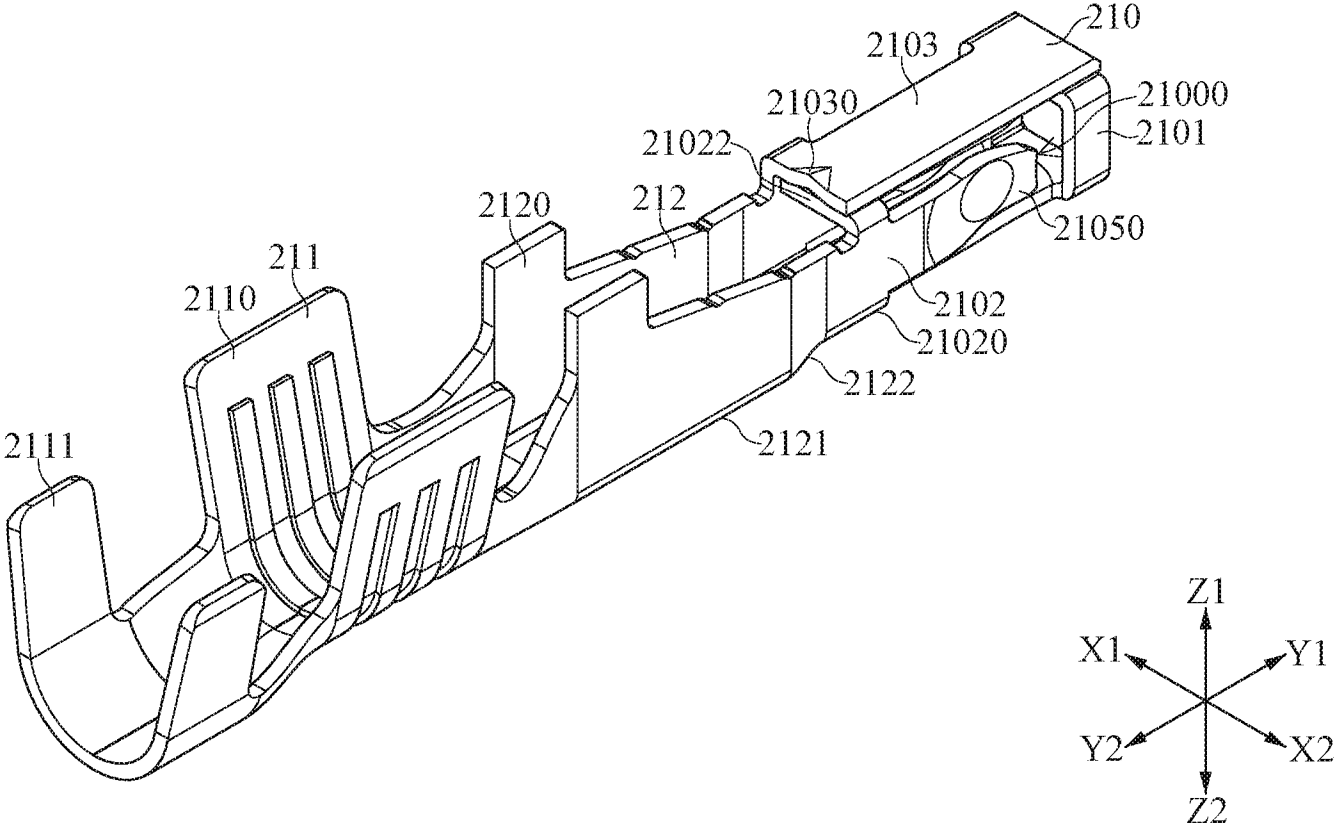
FIG. 5 is a schematic perspective view of the female terminal with respect to FIG. 4 from another perspective.
Figure 6:
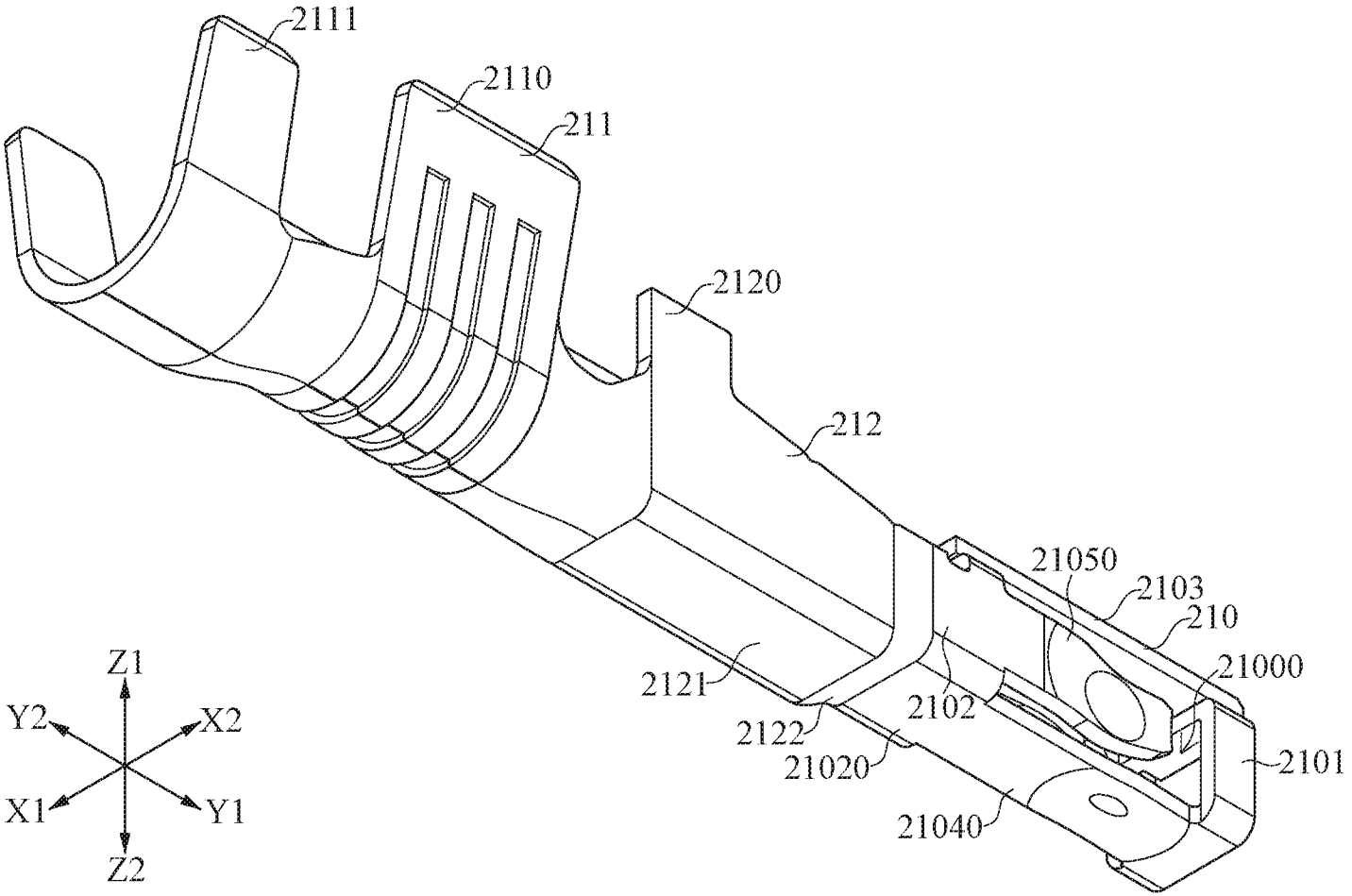
FIG. 6 is a schematic perspective view of the female terminal with respect to FIG. 5 from another perspective.
Figure 7:
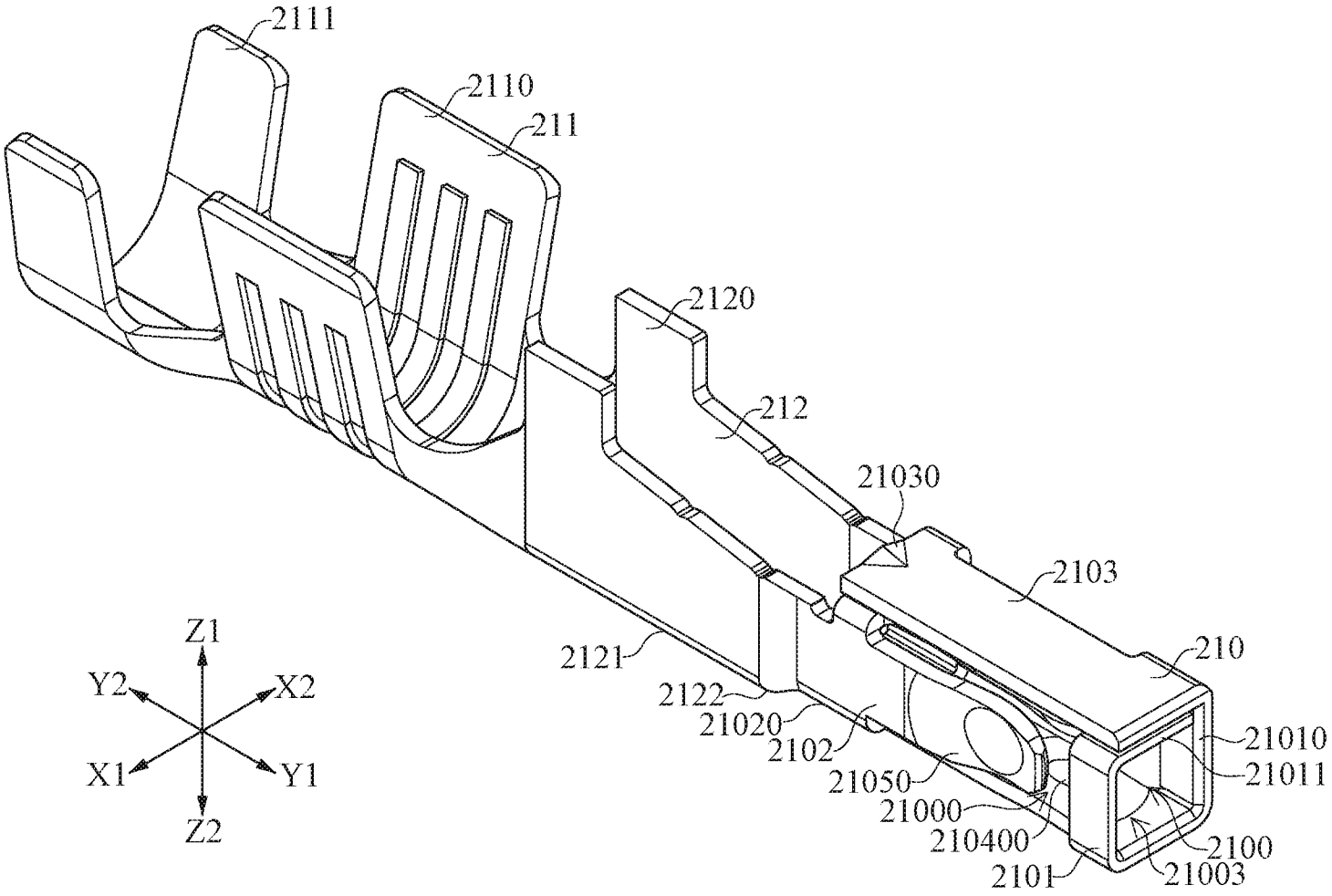
FIG. 7 is a schematic perspective view of the female terminal with respect to FIG. 6 from another perspective.
Figure 8:
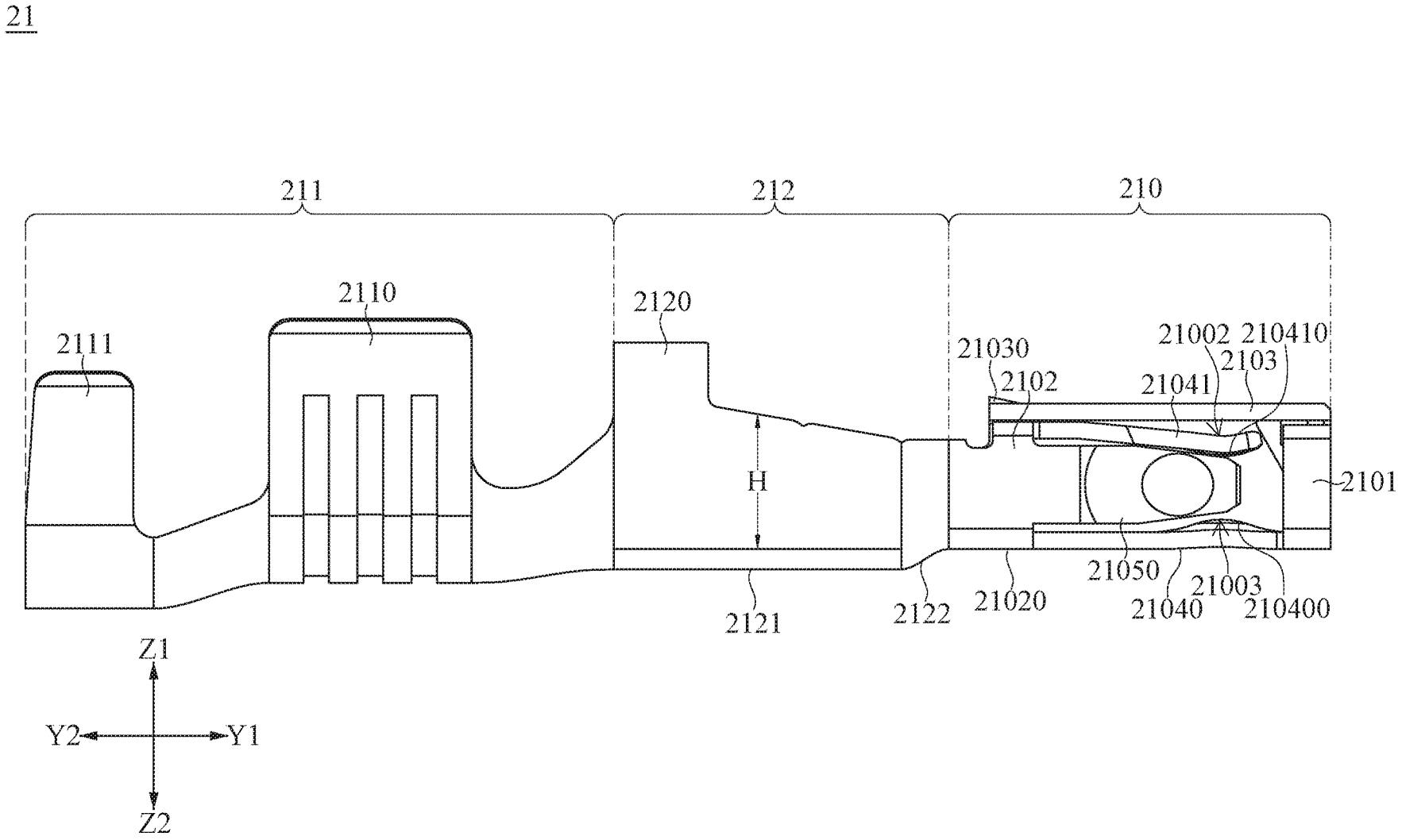
FIG. 8 is a schematic side plan view of the female terminal with respect to FIG. 5.
Figure 9:
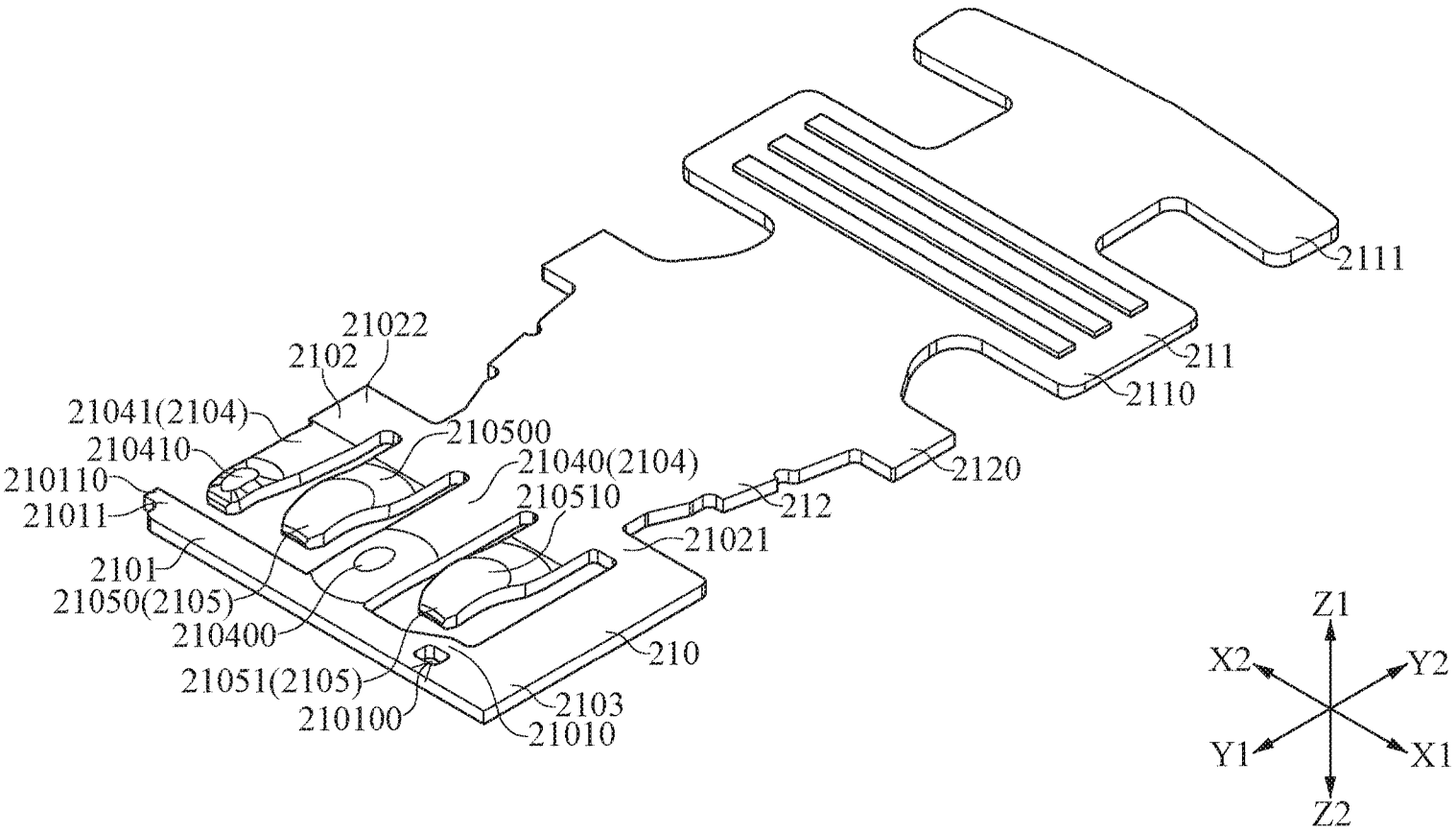
FIG. 9 is an expanded schematic perspective view of the female terminal relative to FIG. 4.
Figure 10:
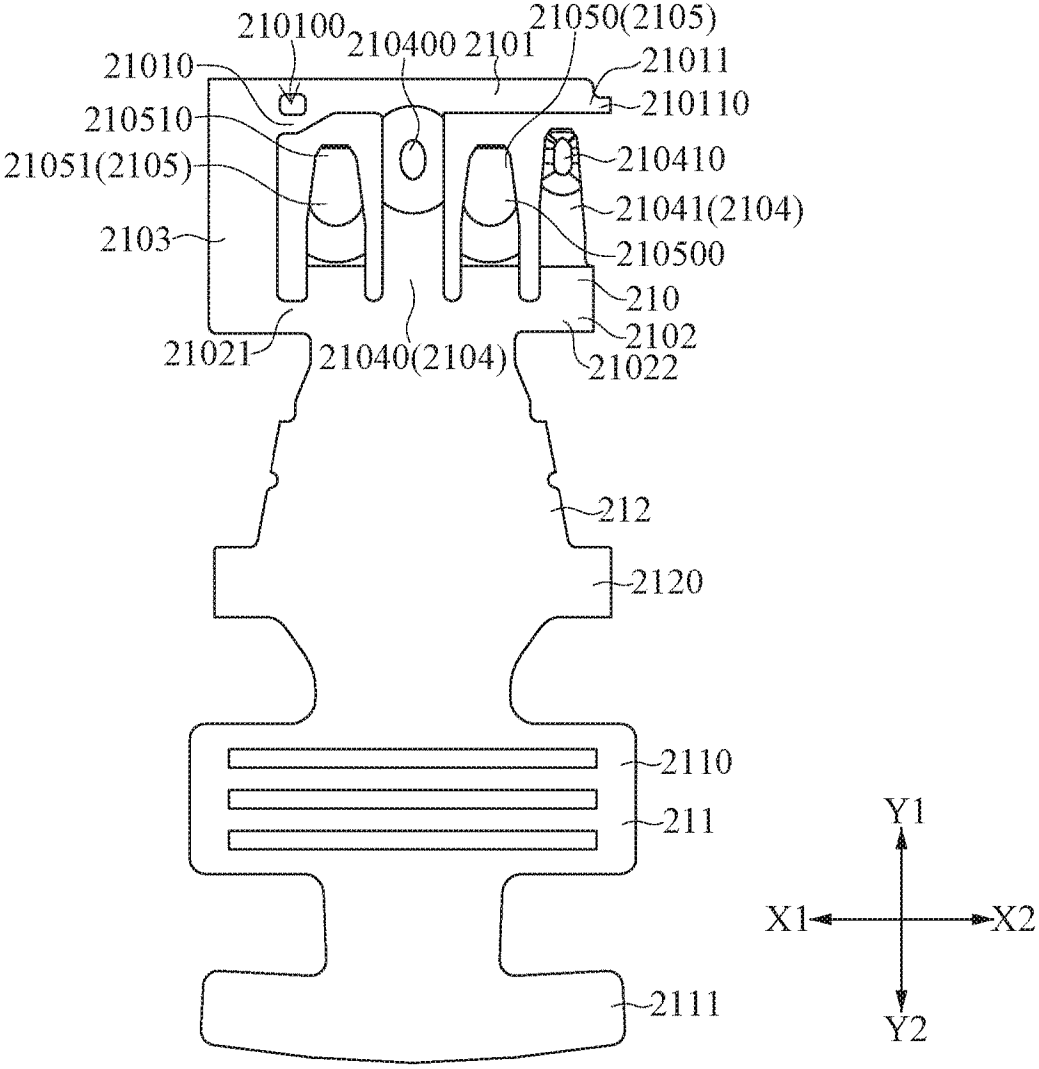
FIG. 10 is an expanded schematic plan view of the female terminal with respect to FIG. 9.

FIG. 4 is a schematic perspective view of the female terminal 21 of the plug connector 2 of FIG. 3. FIG. 5 is a schematic perspective view of the female terminal 21 with respect to FIG. 4 from another perspective. FIG. 6 is a schematic perspective view of the female terminal 21 with respect to FIG. 5 from another perspective. FIG. 7 is a schematic perspective view of the female terminal 21 with respect to FIG. 6 from another perspective. FIG. 8 is a schematic side plan view of the female terminal 21 with respect to FIG. 5. FIG. 9 is an expanded schematic perspective view of the female terminal 21 with respect to FIG. 4. FIG. 10 is an expanded schematic plan view of the female terminal 21 relative to FIG. 9.

Referring to FIG. 4 to FIG. 10, the female terminal 21 includes an insert portion 210, a wiring portion 211 and a connecting portion 212 connecting the insert portion 210 and the wiring portion 211. A structure before assembling, a assembling process and a structure after assembling of the female terminal 21 will be described below.

Referring to FIG. 9 and FIG. 10, a structure of the female terminal 21 before assembling is illustrated, the insert portion 210 includes a front frame portion 2101, a rear frame portion 2102 spaced apart from the front frame portion 2101 in the front-rear direction Y1-Y2, a top plate portion 2103 connecting the front frame portion 2101 and the rear frame portion 2102, an arc discharge contact member 2104 and a primary contact member 2105.

The arc discharge contact member 2104 includes a bottom plate portion 21040 connecting the front frame portion 2101 and the rear frame portion 2102 (see FIG. 8) and a top elastic arm 21041 extending from the rear frame portion 2102 to the front frame portion 2101 (see FIG. 8). The arc discharge contact member 2104 replaces the primary contact member 2105 to bear the arc discharge occurring on the female terminal 21, which will be described in detail as follows. In addition, the bottom plate portion 21040 includes a bottom plate contact portion 210400. Similarly, the top elastic arm 21041 includes a top contact portion 210410.

The primary contact member 2105 includes a first elastic arm 21050 which extends from the rear frame portion 2102 to the front frame portion 2101 and is adjacent between the bottom plate portion 21040 and the top elastic arm 21041 (see FIG. 10) and a second elastic arm 21051 which extends from the rear frame portion 2102 to the front frame portion 2101, is adjacent between the top plate portion 2103 and the bottom plate portion 21040 (see FIG. 10) and spaced apart from the first elastic arm 21050 in a left-right direction X2-X1 (see FIG. 4). In addition, the first elastic arm 21050 includes a first contact portion 210500. Similarly, the second elastic arm 21051 includes a second contact portion 210510.

Because the top elastic arm 21041, the first elastic arm 21050 and the second elastic arm 21051 are cantilever structures, the top elastic arm 21041, the first elastic arm 21050 and the second elastic arm 21051 have good flexibility, and the top elastic arm 21041, the first elastic arm 21050 and the second elastic arm 21051 are more resistant to fretting corrosion with respect to terminal contact surfaces thereof.

The front frame portion 2101 includes a first end portion 21010 and a second end portion 21011 which are opposite to each other. The first end portion 21010 is connected with the top plate portion 2103, and the second end portion 21011 is a free end. The first end portion 21010 includes a catch hole 210100, and the second end portion 21011 includes a protrusion 210110.

The rear frame portion 2102 includes a first end portion 21021 and a second end portion 21022 which are opposite to each other. The first end portion 21021 is connected with the top plate portion 2103. The second end portion 21022 is a free end.

In the process of assembling the female terminal 21 to be a three-dimensional female terminal, a protrusion 210110 is inserted into the catch hole 210100. In this way, the front frame portion 2101 of the female terminal 21 is relatively difficult to deform, thereby avoiding the female terminal 21 being damaged by the male terminal 31 when the male terminal 31 is obliquely inserted into the female terminal 21.

Referring to FIG. 4 to FIG. 8, a structure of the female terminal 21 after assembling is illustrated, in the embodiment, the front frame portion 2101 is a rectangular frame. However, the present disclosure is not limited thereto. In other embodiments, the front frame portion 2101 may be a frame having other shape. In addition, in the embodiment, the rear frame portion 2102 is a rectangular frame. However, the present disclosure is not limited thereto. In other embodiments, the rear frame portion 2102 may be a frame having other shape.

The insert portion 210 defines an insert space 2100 to allow the male terminal 31 to insert therein. When viewed from the insert portion 210 toward the wiring portion 211, the top plate portion 2103 is positioned above the front frame portion 2101 and the rear frame portion 2102.

In addition, the top elastic arm 21041 is positioned below the top plate portion 2103. In this way, when the male terminal 31 is inserted into the insert space 2100, the top elastic arm 21041 is elastically deformed by the squeezing of the male terminal 31 and is displaced upwardly to contact the top plate portion 2103, thereby making the top elastic arm 21041 form a simple support beam effect. Therefore, a normal force applied to the top contact portion 210410 of the top elastic arm 21041 is increased, which can provide a lower and more stable contact resistance. Furthermore, the top plate portion 2103 is spaced apart from the bottom plate portion 21040 in an up-down direction Z1-Z2.

In addition, the insert space 2100 includes a left side 21000 and a right side 21001 which are spaced apart from each other in the left-right direction X2-X1 and an up side 21002 and a down side 21003 which are spaced apart from each other in the up-down direction Z1-Z2 (see FIG. 4).

The bottom plate contact portion 210400 of the bottom plate portion 21040 is positioned in the insert space 2100 and provided at the down side 21003 of the insert space 2100 (see FIG. 7 and FIG. 9), the bottom plate contact portion 210400 serves as a secondary contact point of the female terminal 21. Specifically, the bottom plate contact portion 210400 is formed by bulging the bottom plate portion 21040 toward the insert space 2100. In addition, the bottom plate contact portion 210400 is an elliptical surface. The inserting angle of the male terminal 31 is smaller with respect to the elliptical surface when the male terminal 31 is inserted into the female terminal 21. Therefore, without sacrificing the normal force and Hertzian stress, the inserting force can still be kept lower. However, the present disclosure is not limited thereto. In some embodiments, the bottom plate contact portion 210400 may be any other geometric shape.

The top contact portion 210410 of the top elastic arm 21041 faces the bottom plate contact portion 210400 and is positioned in the insert space 2100, the top contact portion 210410 serves as a secondary contact point of the female terminal 21. Specifically, the top contact portion 210410 is positioned at a tip of the top elastic arm 21041 and is provided at the up side 21002 of the insert space 2100 (see FIG. 8). In some embodiments, the top contact portion 210410 is aligned with the bottom plate contact portion 210400 of the bottom plate portion 21040 in the front-rear direction Y1-Y2 and the left-right direction X2-X1 (see FIG. 8). The top contact portion 210410 is an elliptical surface. The inserting angle of the male terminal 31 is smaller with respect to the elliptical surface when the male terminal 31 is inserted into the female terminal 21. Therefore, without sacrificing the normal force and Hertzian stress, the inserting force can still be kept lower. However, the present disclosure is not limited thereto. In some embodiments, the top contact portion 210410 may be any other geometric shape.

The first contact portion 210500 of the first elastic arm 21050 is positioned in the insert space 2100, the first contact portion 210500 serves as a primary contact point of the female terminal 21. Specifically, the first contact portion 210500 is positioned at a tip of the first elastic arm 21050 and provided at the left side 21000 of the insert space 2100. In addition, the first contact portion 210500 is an elliptical surface. The inserting angle of the male terminal 31 is smaller with respect to the elliptical surface when the male terminal 31 is inserted into the female terminal 21. Therefore, without sacrificing the normal force and Hertzian stress, the inserting force can still be kept lower. However, the present disclosure is not limited thereto. In some embodiments, first contact portion 210500 may be any other geometric shape. In addition, the top contact portion the 210410 and the bottom plate contact portion 210400 are positioned in front of the first contact portion 210500 in the front-rear direction Y1-Y2 (see FIG. 8).

The second contact portion 210510 of the second elastic arm 21051 faces the first contact portion 210500 and positioned in the insert space 2100, the second contact portion 210510 serves as a primary contact point of the female terminal 21. Specifically, the second contact portion 210510 is positioned at a tip of the second elastic arm 21051 and provided at the right side 21001 of the insert space 2100. In some embodiments, the second contact portion 210510 is aligned with the first contact portion 210500 of the first elastic arm 21050 in the front-rear direction Y1-Y2 and the up-down direction Z1-Z2. The second contact portion 210510 is an elliptical surface. The inserting angle of the male terminal 31 is smaller with respect to the elliptical surface when the male terminal 31 is inserted into the female terminal 21. Therefore, without sacrificing the normal force and Hertzian stress, the inserting force can still be kept lower. However, the present disclosure is not limited to this. In some embodiments, the second contact portion 210510 may be any other geometric shape. The top contact portion 210410 and the bottom plate contact portion 210400 are positioned in front of the second contact portion 210510 in the front-rear direction Y1-Y2.

When the male terminal 31 is inserted under electric hot plug, the top contact portion 210410 positioned at the up side 21002 of the insert space 2100 and the bottom plate contact portion 210400 positioned at the down side 21003 of the insert space 2100 contact the male terminal 31 earlier than the first contact portion 210500 positioned at the left side 21000 of the insert space 2100 and the second contact portion 210510 positioned at the right side 21001 of the insert space 2100. That is, the male terminal 31 contacts the arc discharge contact member 2104 before the male terminal 31 contacts the primary contact member 2105, and thus any arc discharge between the male terminal 31 and the female terminal 21 occurs at the arc discharge contact member 2104. In this way, the electric spark generated due to the insertion will only be remained on the top contact portion 210410 and the bottom plate contact portion 210400 which serve as the secondary contact points, and the first contact portion 210500 and the second contact portion 210510 which serve as the primary contact points will not be affected. Therefore, the female terminal 21 has a function of hot plug.

In addition, referring back to FIG. 3 and FIG. 5, the wiring portion 211 includes a wire clamp 2110 for clamping a conductive body 50 of the wire 5 and a sheath clamp 2111 for clamping a sheath 51 of the wire 5.

Figure 11:
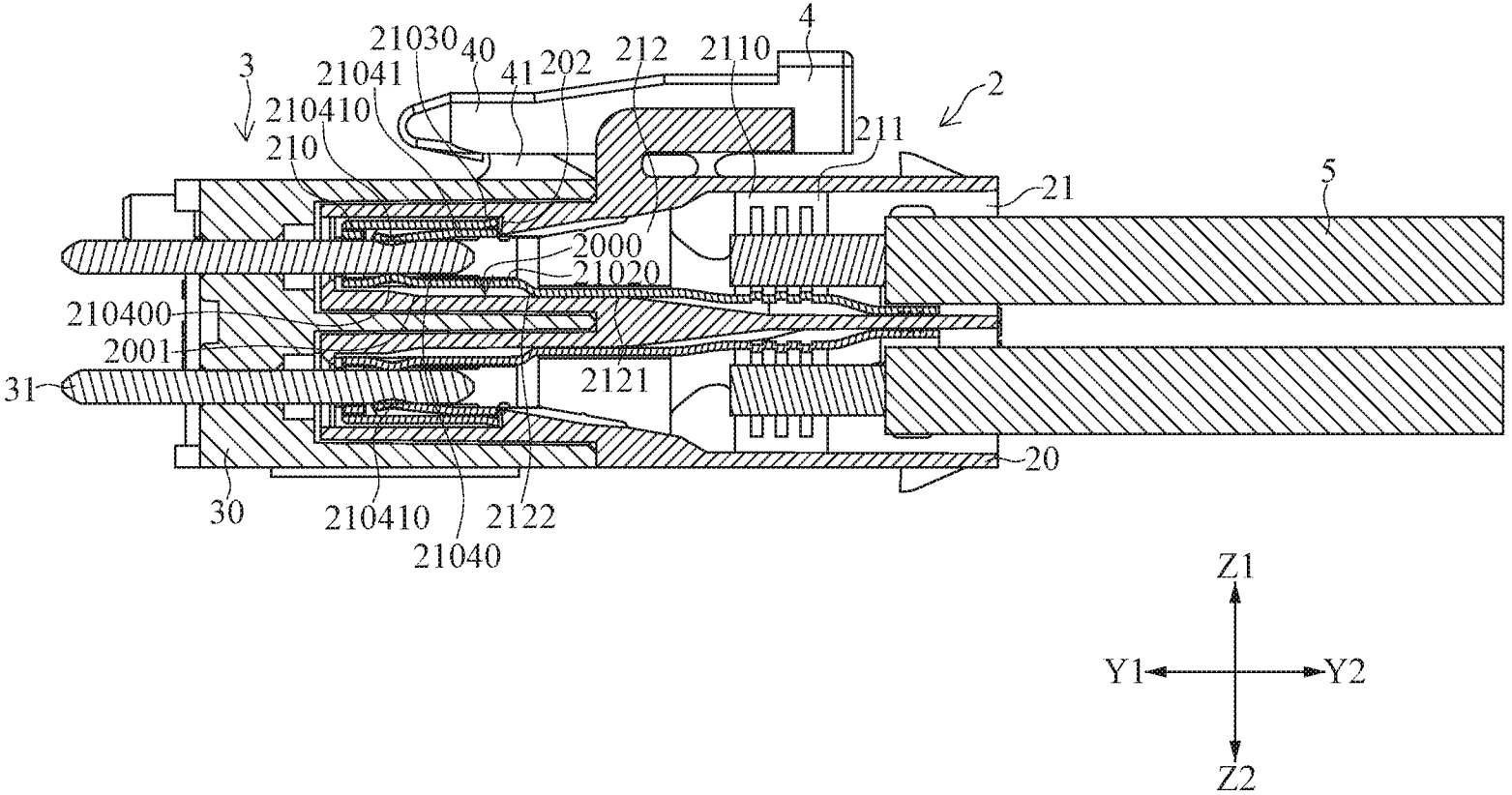
FIG. 11 is a schematic cross-sectional plan view of the power connector of FIG. 1 taken along a cross-sectional line in a front-rear direction to illustrate a bottom plate contact portion and a first contact portion of the female terminal of FIG. 4.

FIG. 11 is a schematic cross-sectional plan view of the power connector 1 of FIG. 1 taken along a cross-sectional line in the front-rear direction Y1-Y2 to illustrate the bottom plate contact portion 210400 and the first contact portion 210410 of the female terminal 21 of FIG. 4. Referring to FIG. 11, FIG. 11 illustrates two female terminals 21, the following description will mainly focus on the female terminal 21 close to the up. The top contact portion 210410 and the bottom plate contact portion 210400 positioned in the insert space 2100 contact the male terminal 31.

The rear frame portion 2102 includes a rear frame bottom portion 21020. The connecting portion 212 further includes a connecting bottom portion 2121 which is lower than the rear frame bottom portion 21020 and a step portion 2122 which connects the connecting bottom portion 2121 and the rear frame bottom portion 21020. In this way, the bottom plate portion 21040 of the female terminal 21 is separated from an inner wall 2001 of the terminal receiving groove 200 of the insulating housing 20 in the up-down direction Z1-Z2, so that there is a gap 2000 between the bottom plate portion 21040 of the female terminal 21 and the inner wall 2001 of the terminal receiving groove 200. The gap 2000 can provide floatability for the female terminal 21.

In addition, referring to FIG. 4 and FIG. 11 at the same time, an edge bulging portion 21030 bulges upwardly from a rear edge of the top plate portion 2103 of the female terminal 21. The insulating housing 20 further includes a locking shoulder 202 which latches with the edge bulging portion 21030 and has elasticity. Specifically, the edge bulging portion 21030 latches with a side surface of the locking shoulder 202 toward the front so as to prevent the female terminal 21 from withdrawing the insulating housing 20 after the female terminal 21 is inserted into the insulating housing 20. In addition, the edge bulging portion 21030 can provide a better hand feel and a reminder sound in the process of assembling the female terminal 21 into the insulating housing 20.

Figure 12:
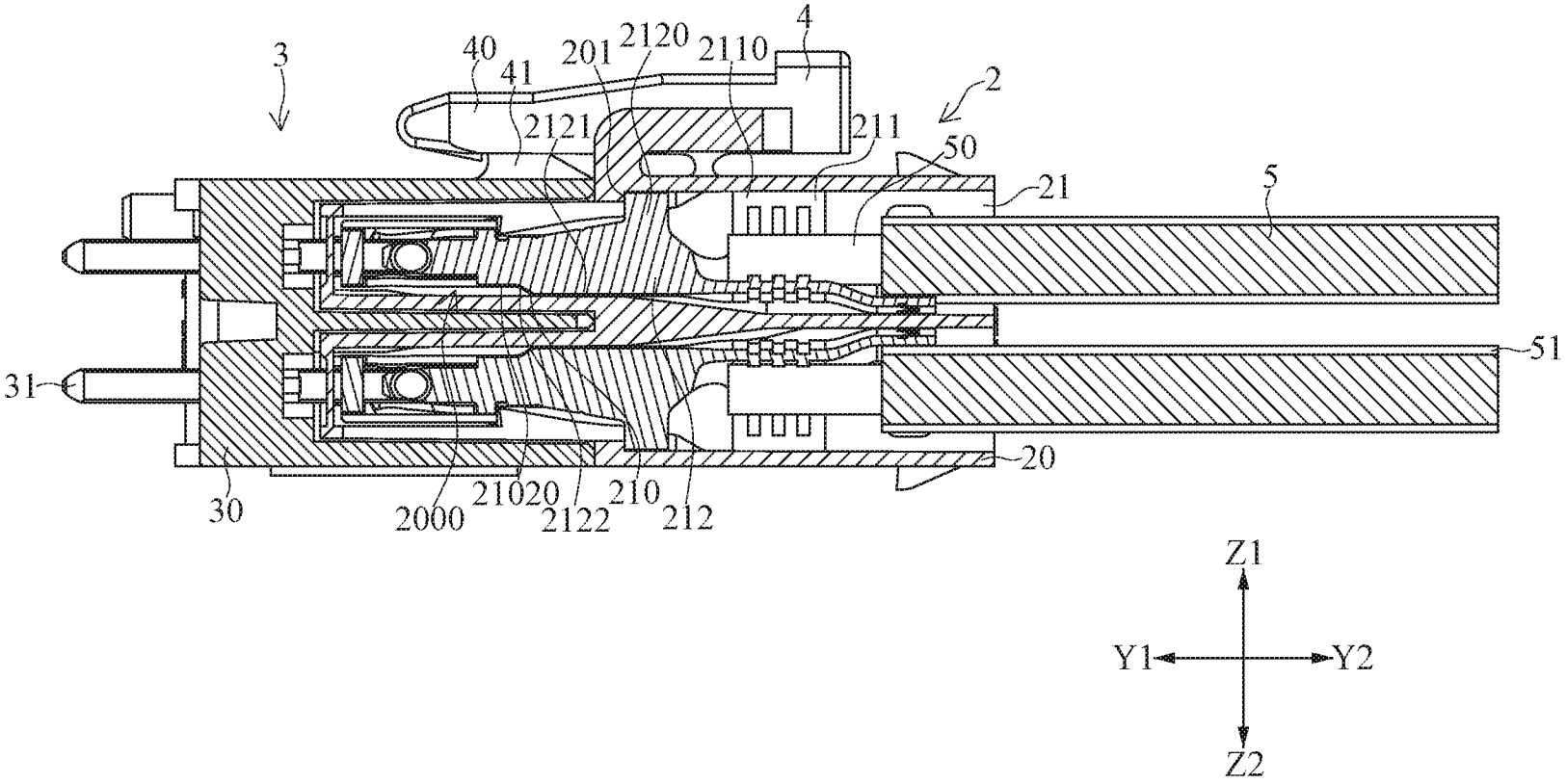
FIG. 12 is a schematic cross-sectional plan view of the power connector of FIG. 1 taken along a cross-sectional line in the front-rear direction to illustrate a stop wall of an insulating housing.

FIG. 12 is a schematic cross-sectional plan view of the power connector 1 of FIG. 1 taken along a cross-sectional line in the front-rear direction Y1-Y2 to illustrate a stop wall 201 of an insulating housing 20. Referring to FIG. 12, the connecting portion 212 of the female terminal 21 further includes a plurality of stopping portions 2120 configured to abut against a stop wall 201 of the insulating housing 20. The embodiment includes two stopping portions 2120. Specifically, each stopping portion 2120 provides a guiding function and an anti-misinsertion function when the female terminal 21 is assembled into the corresponding terminal receiving groove 200. In addition, a head portion of each stopping portion 2120 is rounded to make assembling of the female terminal 21 relatively smoothly.

In the description of the present disclosure, the left-right direction X2-X1, the front-rear direction Y1-Y2, the up-down direction Z1-Z2 are used to illustrate the relative position relationship and action relationship of the components of FIG. 1 to FIG. 12. That is, these directions are not absolute directions, but relative directions. Thus these directions are not limited to the orientations of the components of FIG. 1 to FIG. 12. The explanation on the directions described in the present disclosure should be changed depending on the changing of the orientations of the components of FIG. 1 to FIG. 12.

While the present disclosure and advantages thereof are described in detail, it is understood that various changes, replacements and substitutions may be made without departing from the spirit and scope of the present disclosure defined by the appended claims. For example, many processes described above can be implemented in a variety of ways, and many processes described above can be replaced with other processes or combinations thereof. Further, the scope of the present disclosure is not limited to the specific embodiments of process, machinery, manufacturing, substance composition, means, method or step described in the specification. Those skilled in the art can understand from the disclosed contents of the present disclosure that existing or future developed process, machinery, manufacturing, substance composition, means, method or step which has the same function or achieve essentially the same result as the corresponding embodiment described herein can be used in accordance with the present disclosure. Accordingly, such a process, machinery, manufacturing, substance composition, mean, method or step is included in the claims of the present disclosure.

What is claimed is:

1. A connector, comprising:

an insulating housing defining a terminal receiving groove therein, and the insulating housing comprising a stop wall; and a terminal positioned in the terminal receiving groove of the insulating housing, and the terminal comprising:

an insert portion defining an insert space therein, and the insert portion comprising:

a front frame portion;

a rear frame portion spaced apart from the front frame portion in a front-rear direction;

a top plate portion connecting the front frame portion and the rear frame portion;

an arc discharge contact member comprising:

a bottom plate portion connecting the front frame portion and the rear frame portion and spaced apart from the top plate portion in an up-down direction; and a top elastic arm extending from the rear frame portion to the front frame portion and positioned below the top plate portion;

a primary contact member, wherein the arc discharge contact member is positioned in front of the primary contact member, and the primary contact member comprising:

a first elastic arm which extends from the rear frame portion to the front frame portion and is adjacent between the bottom plate portion and the top elastic arm; and a second elastic arm which extends from the rear frame portion to the front frame portion, is adjacent between the top plate portion and the bottom plate portion, and spaced apart from the first elastic arm in a left-right direction;

a wiring portion; and a connecting portion connecting the insert portion and the wiring portion, and the connecting portion comprising a stopping portion which is configured to abut against the stop wall of the insulating housing, wherein the front frame portion and the rear frame portion each comprise a first end portion and a second end portion which are opposite to each other, the first end portion is connected with the top plate portion, the second end portion is a free end, and the top plate portion is positioned above the front frame portion and the rear frame portion.

2. The connector of claim 1, wherein, the bottom plate portion comprises a bottom plate contact portion;

the top elastic arm comprises a top contact portion which faces the bottom plate contact portion and is positioned in the insert space;

the first elastic arm comprises a first contact portion which is positioned in the insert space;

the second elastic arm comprises a second contact portion which faces the first contact portion and is positioned in the insert space, wherein, the top contact portion and the bottom plate contact portion are positioned in front of the first contact portion and the second contact portion.

3. The connector of claim 2, wherein the bottom plate contact portion, the top contact portion, the first contact portion and the second contact portion are respectively provided at a down side, an up side, a left side and a right side of the insert space.

4. The connector of claim 3, wherein the top contact portion, the first contact portion and the second contact portion are respectively positioned in a tip of the top elastic arm, a tip of the first elastic arm and a tip of the second elastic arm.

5. The connector of claim 2, wherein the top contact portion, the first contact portion and the second contact portion each are an elliptical surface.

6. The connector of claim 1, wherein the first end portion of the front frame portion comprises a catch hole, and the second end portion of the front frame portion comprises a protrusion which is configured to insert into the catch hole.

7. The connector of claim 1, wherein the rear frame portion comprises a rear frame bottom portion, and wherein the connecting portion further comprises a connecting bottom portion which is lower than the rear frame bottom portion and a step portion which connects the connecting bottom portion and the rear frame bottom portion.

8. The connector of claim 1, wherein there is a gap between the bottom plate portion of the terminal and an inner wall of the insulating housing in the up-down direction.

9. The connector of claim 1, wherein the bottom plate contact portion is formed by bulging the bottom plate portion toward the insert space.

10. The connector of claim 1, wherein an edge bulging portion bulges upwardly from a rear edge of the top plate portion, and wherein the insulating housing further comprises a locking shoulder which latches with the edge bulging portion and has elasticity.

11. The connector of claim 1, wherein the connector is a vehicle connector.

12. A terminal, comprising:

an insert portion defining an insert space therein, and the insert portion comprising:

a front frame portion;

a rear frame portion spaced apart from the front frame portion in a front-rear direction;

a top plate portion connecting the front frame portion and the rear frame portion;

an arc discharge contact member comprising:

a bottom plate portion connecting the front frame portion and the rear frame portion and spaced apart from the top plate portion in an up-down direction; and a top elastic arm extending from the rear frame portion to the front frame portion and positioned below the top plate portion;

a primary contact member, wherein the arc discharge contact member is positioned in front of the primary contact member, the primary contact member comprising:

a first elastic arm which extends from the rear frame portion to the front frame portion and is adjacent between the bottom plate portion and the top elastic arm; and a second elastic arm which extends from the rear frame portion to the front frame portion, is adjacent between the top plate portion and the bottom plate portion and spaced apart from the first elastic arm in a left-right direction;

a wiring portion; and a connecting portion connecting the insert portion and the wiring portion, wherein the front frame portion and the rear frame portion each comprise a first end portion and a second end portion which are opposite to each other, the first end portion is connected with the top plate portion, the second end portion is a free end, and the top plate portion is positioned above the front frame portion and the rear frame portion.

13. The terminal of claim 12, wherein the bottom plate portion comprises a bottom plate contact portion;

the top elastic arm comprises a top contact portion which faces the bottom plate contact portion and is positioned in the insert space;

the first elastic arm comprises a first contact portion which is positioned in the insert space;

the second elastic arm comprises a second contact portion which faces the first contact portion and is positioned in the insert space;

wherein, the top contact portion and the bottom plate contact portion are positioned in front of the first contact portion and the second contact portion.

14. The terminal of claim 13, wherein the bottom plate contact portion is formed by bulging the bottom plate portion toward the insert space.

15. The terminal of claim 13, wherein the bottom plate contact portion, the top contact portion, the first contact portion and the second contact portion are respectively provided at a down side, an up side, a left side and a right side of the insert space.

16. The terminal of claim 13, wherein the top contact portion, the first contact portion and the second contact portion are respectively positioned in a tip of the top elastic arm, a tip of the first elastic arm and a tip of the second elastic arm.

17. The terminal of claim 13, wherein the top contact portion, the first contact portion and the second contact portion each are an elliptical surface.

18. The terminal of claim 12, wherein the first end portion of the front frame portion comprises a catch hole, the second end portion of the front frame portion comprises a protrusion which is configured to insert into the catch hole.

19. The terminal of claim 12, wherein the rear frame portion comprises a rear frame bottom portion, and wherein the connecting portion further comprises a connecting bottom portion which is lower than the rear frame bottom portion and a step portion which connects the connecting bottom portion and the rear frame bottom portion.

20. The terminal of claim 12, wherein an edge bulging portion bulges upwardly from a rear edge of the top plate portion.

* * * * *